US007225778B2

(12) United States Patent
Reissner et al.

(10) Patent No.: US 7,225,778 B2
(45) Date of Patent: Jun. 5, 2007

(54) SHEATED-ELEMENT GROW PLUG HAVING A SUBSTANTIALLY SHORTENED CONTROL FILAMENT

(75) Inventors: Andreas Reissner, Stuttgart (DE); Vera Wein, Stuttgart (DE); Armin Kussmaul, Bietigheim-Bissingen (DE); Steffen Carbon, Schorndorf (DE); Christoph Kern, Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 51 days.

(21) Appl. No.: 10/514,331

(22) PCT Filed: Jun. 26, 2003

(86) PCT No.: PCT/DE03/02127

§ 371 (c)(1),
(2), (4) Date: Nov. 11, 2004

(87) PCT Pub. No.: WO2004/040195

PCT Pub. Date: May 13, 2004

(65) Prior Publication Data

US 2006/0102611 A1 May 18, 2006

(30) Foreign Application Priority Data

Oct. 19, 2002 (DE) ..... 102 48 802

(51) Int. Cl.
*F02B 9/10* (2006.01)
*F23Q 7/00* (2006.01)

(52) U.S. Cl. ..... 123/145 A; 219/270

(58) Field of Classification Search ..... 123/145 R, 123/145 A; 219/260–270, 253–254
See application file for complete search history.

(56) References Cited

U.S. PATENT DOCUMENTS

| | | | | |
|---|---|---|---|---|
| 5,521,356 | A * | 5/1996 | Bauer | 219/270 |
| 5,767,485 | A * | 6/1998 | Kumada | 219/270 |
| 6,590,185 | B2 * | 7/2003 | Kasimirski et al. | 219/270 |
| 6,734,399 | B2 * | 5/2004 | Asano et al. | 219/270 |
| 6,878,903 | B2 * | 4/2005 | Duba | 219/270 |
| 6,930,283 | B2 * | 8/2005 | Reissner et al. | 219/270 |

FOREIGN PATENT DOCUMENTS

| | | |
|---|---|---|
| DE | 197 52 099 | 10/1998 |
| EP | 0 392 180 | 10/1990 |
| EP | 1 034 400 | 9/2000 |

* cited by examiner

*Primary Examiner*—Hai Huynh
(74) *Attorney, Agent, or Firm*—Kenyon & Kenyon LLP

(57) ABSTRACT

A sheathed-element glow plug for an internal combustion engine, in which the sheathed-element glow plug is arranged or constructed so that it substantially reduces the glow temperature during the heat-up process. The control filament is considerably shortened and has a resistance between 20 mΩ and 100 mΩ.

5 Claims, 1 Drawing Sheet

SHEATED-ELEMENT GROW PLUG HAVING A SUBSTANTIALLY SHORTENED CONTROL FILAMENT

FIELD OF THE INVENTION

The present invention relates to a sheathed-element glow plug for an internal combustion engine, having a plug housing, a terminal device connected to the plug housing for the glow current, a glow tube connected to the terminal device, which is sealed on its side facing away from the plug housing, a wire filament-shaped resistor element provided on the terminal stud connected to the terminal device in the glow tube, the resistor element being composed of a heating filament and a control filament.

BACKGROUND INFORMATION

There are sheathed-element glow plugs for diesel engines. Such sheathed-element glow plugs are operated at vehicle electrical system voltages of approximately 11 V for pre-glow and approximately 14 V for a running engine. These sheathed-element glow plugs are controlled by a glow time controller without voltage-reducing measures. This means that the sheathed-element glow plugs are intrinsically safe and they regulate the current during heat-up in such a way that no critical temperatures are exceeded.

European patent document no. 1 034 400 discusses such sheathed-element glow plugs having a reduced control filament portion. This control filament portion is defined such that, when operated using vehicle system voltages, the sheathed-element glow plug cannot be regulated down to operating temperature, but is operated at a temperature which is higher than the admissible temperature. The design of the control filament causes the sheathed-element glow plug to heat up the combustion chamber of an internal combustion engine very rapidly. The operating temperature is regulated by the glow time controller, which sets the voltage via timing (pulse-width modulation).

SUMMARY OF THE INVENTION

An object of the exemplary embodiment and/or exemplary method of the present invention is to further reduce the heat-up time of the sheathed-element glow plug. A voltage dip of the vehicle system voltage when the engine is started should not result in a temperature dip of the sheathed-element glow plug.

The exemplary embodiment and/or exemplary method of the present invention is intended to further considerably reduce the glow time by designing the control filament portion to be substantially shorter and setting its resistance to a few mΩ.

Therefore, with the exemplary embodiment and/or exemplary method of the present invention the control filament has a resistance between 20 mΩ and 100 mΩ.

Designing the control filament to have such a low resistance, which may be in the range between 20 mΩ and 100 mΩ, reduces the nominal voltage (the voltage at which the sheathed-element glow plug reaches its operating temperature).

This reduces the heat-up time of the sheathed-element glow plug from approximately 6 seconds to 2 seconds, which is intended to provide a significantly quicker start of the diesel engine.

Another advantage results from the fact that, by reducing the nominal voltage, the effective voltage may be controlled by a glow time controller in such a way that no temperature dip of the sheathed-element glow plug occurs during the voltage dip when the internal combustion engine is started. As a result, the diesel engine starts considerably more rapidly and reliably. In addition, the engine ramps up to idling speed more rapidly and reliably.

In the warm-up phase of the engine, the temperature of the sheathed-element glow plug may be kept at the appropriate level by adjusting the pulse rate of the glow time controller. This makes the idling of the cold engine quieter, while reducing harmful emissions. By switching to overrun in a controlled manner, harmful emissions may be reduced when the accelerator is pressed again.

The heated zone of the sheathed-element glow plug is reduced (due to the compact design of the control filament), so that only the area of the sheathed-element glow plug actually protruding into the combustion chamber is heated. The electrical balance of the vehicle is thus improved and engine fuel is saved.

Due to the considerably shortened control filament portion, the sheathed-element glow plug responds, even when warm or hot, to an increase in voltage very rapidly. This is intended to provide prompt adjustment of the sheathed-element glow plug temperature to the requirements of the diesel engine.

According to the exemplary embodiment and/or exemplary method of the present invention, the shortened area of the control filament may have different designs.

One end of the control filament is connected to a terminal stud, which is in turn electrically connected to the terminal device. The terminal stud is either inserted far into the heating area in the glow tube or, as an alternative, the terminal stud may use an available arrangement and the control filament may have an appropriately low resistance using unwound wire.

DETAILED DESCRIPTION

Figure 1:
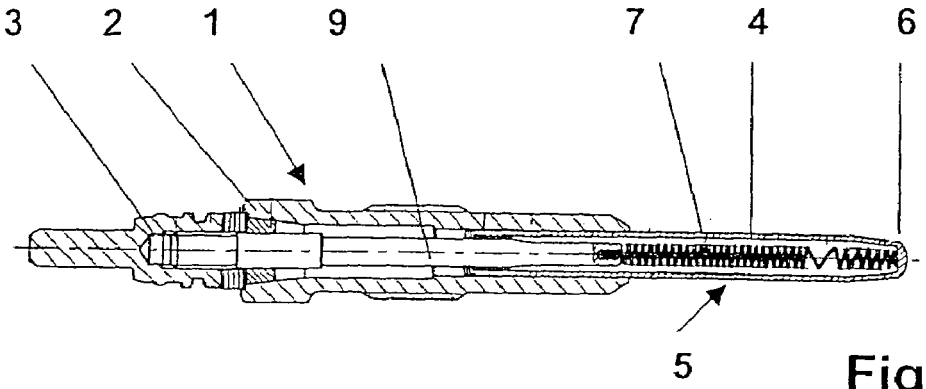
FIG. 1 shows a section of a sheathed-element glow plug as known from the related art.

FIG. 1 shows the sheathed-element glow plug from the related art. This sheathed-element glow plug 1 includes a plug housing 2. A terminal device 3 via which the glow current is supplied to sheathed-element glow plug 1 is provided in plug housing 2. Furthermore, a glow tube 4, which is connected to terminal device 3, is provided. A resistor element 5 is provided in glow tube 4, resistor element 5 being divided into two areas: a heating filament 6 and a control filament 7. Heating filament 6 is connected (welded) to control filament 7. The end of control filament 7 opposite heating filament 6 is connected to a terminal stud 9, terminal stud 9 being designed as part of the terminal device, the glow current thus being supplied via terminal stud 9 to control filament 7 and heating filament 6.

Figure 2:
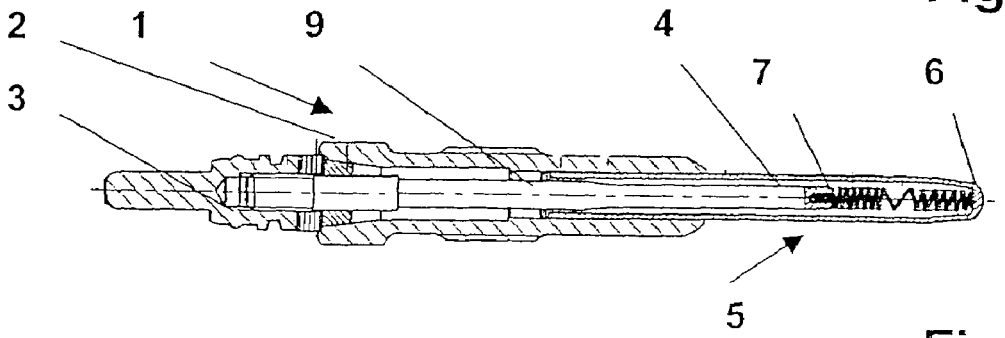
FIG. 2 shows a section of a first exemplary embodiment of a sheathed-element glow plug having a shortened control filament according to the present invention.

In the exemplary embodiment of the present invention depicted in FIG. 2, terminal stud 9 has a considerably longer design within glow tube 4 according to the exemplary embodiment and/or exemplary method of the present invention, so that control filament 7 has a very short design.

Figure 3:
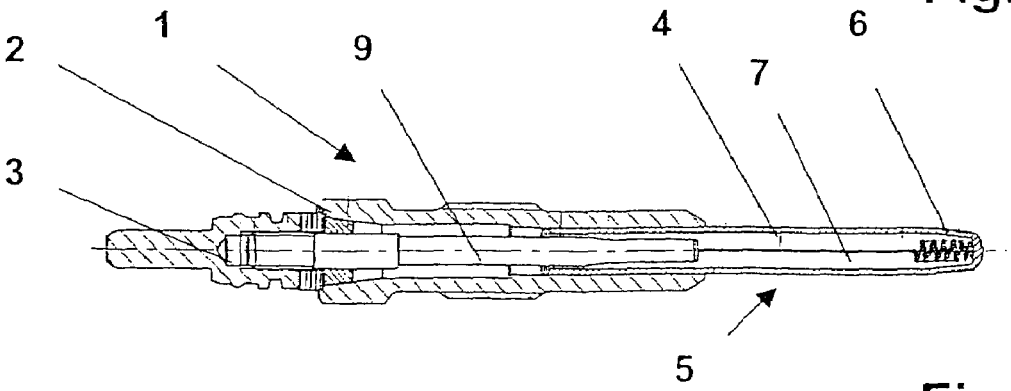
FIG. 3 shows a section of a second exemplary embodiment of a sheathed-element glow plug according to the present invention in which the heating filament is connected to the terminal stud by a straight element made of the same material.

FIG. 3, as an alternative to FIG. 2, depicts terminal stud 9 of a design comparable to that of the related art, heating filament 6 being directly connected to terminal stud 9. The straight piece is made of the same material as heating filament 6.

What is claimed is:

1. A sheathed-element glow plug for an internal combustion engine, comprising:

a plug housing;

a terminal device connected to the plug housing for a glow current;

a glow tube connected to the terminal device and sealed at its end facing away from the plug housing; and a wire filament-shaped resistor element positioned in the glow tube on a terminal stud connected to the terminal device, wherein the resistor element being includes a heating filament and a control filament, and the control filament has a resistance between 20 mΩ and 100 mΩ.

2. The glow plug of claim 1, wherein the resistor element in the glow tube is concentrated in an area of an end of the glow tube facing away from the plug housing, and wherein the resistor element occupies one-third to two-thirds of a free length of the glow tube.

3. The glow plug of claim 2, wherein the terminal stud extends into an area situated within a combustion chamber of the internal combustion engine.

4. The glow plug of claim 2, wherein a path between the terminal stud, which is located in the plug housing, and the heating filament is bridged by a straight piece of wire, which is made of the same material as the control filament remote from a combustion chamber of the internal combustion engine.

5. The glow plug of claim 1, wherein the control filament is located at a tip of the glow tube, and the heating filament is located in a part of the glow tube remote from the combustion chamber of the internal combustion engine.

* * * * *